US007610871B2

(12) United States Patent
Leclercq et al.

(10) Patent No.: US 7,610,871 B2
(45) Date of Patent: Nov. 3, 2009

(54) DYNAMIC STABILISATION DEVICE FOR A SUBMARINE VEHICLE

(75) Inventors: Sylvain Leclercq, Marseilles (FR); Stephane Tollet, Marseilles (FR)

(73) Assignee: Sercel, Carquefou (FR)

( * ) Notice: Subject to any disclaimer, the term of this patent is extended or adjusted under 35 U.S.C. 154(b) by 0 days.

(21) Appl. No.: 11/776,855

(22) Filed: Jul. 12, 2007

(65) Prior Publication Data

US 2008/0017094 A1 Jan. 24, 2008

(30) Foreign Application Priority Data

Jul. 13, 2006 (FR) ..... 06 06453

(51) Int. Cl.
*B63G 8/18* (2006.01)

(52) U.S. Cl. ..... 114/244; 114/124; 114/332

(58) Field of Classification Search ..... 114/332, 114/121, 122, 124, 126, 143, 244, 245
See application file for complete search history.

(56) References Cited

U.S. PATENT DOCUMENTS

| | | | | |
|---|---|---|---|---|
| 2,979,010 | A * | 4/1961 | Braddon et al. | 114/126 |
| 3,687,100 | A * | 8/1972 | Larsh | 114/126 |
| 3,934,534 | A * | 1/1976 | Larsh | 114/122 |
| 3,978,813 | A | 9/1976 | Pickens et al. | |
| 4,273,063 | A * | 6/1981 | Berne | 114/126 |
| 4,686,922 | A * | 8/1987 | Burroughs | 114/124 |
| 6,305,309 | B1 | 10/2001 | Ead et al. | |
| 2005/0268835 | A1 | 12/2005 | Le Page et al. | |

FOREIGN PATENT DOCUMENTS

| | | | |
|---|---|---|---|
| EP | 0877262 | | 11/1998 |
| EP | 1598265 | | 11/2005 |
| JP | 62074793 | A * | 4/1987 |

* cited by examiner

*Primary Examiner*—Ed Swinehart
(74) *Attorney, Agent, or Firm*—Young & Thompson

(57) ABSTRACT

A submarine vehicle able to control the navigation of a towed submerged object (3). The vehicle includes a body (5) equipped with stabilizing fins (7*a*, 7*b*, 7*c*), at least one of which (7*c*) is free to rotate and is ballasted, or linked to a ballast, for roll stabilization and/or orientation of the vehicle when it is in motion.

11 Claims, 7 Drawing Sheets

DYNAMIC STABILISATION DEVICE FOR A SUBMARINE VEHICLE

CROSS REFERENCE TO RELATED APPLICATIONS

The present Application incorporates by reference and claims priority to the French Patent Application No. FR06 06453 filed Jul. 13, 2006.

STATEMENT REGARDING FEDERALLY SPONSORED RESEARCH AND DEVELOPMENT

None.

THE NAMES OF THE PARTIES TO A JOIN RESEARCH AGREEMENT

None.

INCORPORATION BY REFERENCE OF MATERIAL SUBMITTED ON COMPACT DISC

None.

BACKGROUND OF THE INVENTION

1. Field of the Invention

In particular, the invention concerns a roll stabilisation system for a moving submarine vehicle.

2. Description of the Relation Art

It is known that autonomous, remotely controlled or towed vehicles are used in submarine applications.

In the case of a static or slow-moving vehicle, the respective positions of the centre of gravity, the centre of volume (the point of application of the buoyancy) and any axis of rotation (in the case of a towed vehicle for example) are often such that the vehicle positions itself naturally in the zero roll position when it is submerged, with the return torque thus created toward the vertical position generally being sufficient to ensure the stability of the vehicle.

On the other hand, in the case of a vehicle that has a preferential direction of motion, hereinafter known as the "vehicle axis", and which is moving quite rapidly (from a few knots to over 10 knots) along this axis, the hydrodynamic effects on the vehicle can overcome the static stabilisation forces described above, and thus cause the vehicle to become unstable.

Stabilisation solutions do exist, which consist, for example, of equipping the vehicle with a list sensor, and of controlling the guidance/orientation means (actuators, control surfaces, fins, etc.) so as to actively control this roll.

These systems have the following drawbacks however:

- The need to equip the vehicle with a power source (internal or external),
- The need to equip the vehicle with a list sensor,
- The need to fit motor-driven actuators on the vehicle,
- The need to create a control loop,
- The power consumed by the actuators, which are often electrical.

SUMMARY OF THE INVENTION

One objective of the invention is to provide a solution to some or all of these drawbacks.

Another aim is to propose the use of a ballast which can simultaneously serve as:

- a list or roll sensor, in relation to a reference angular position, such as the vertical, and which corresponds to a substantially zero roll,
- and a mechanical roll-control source.

According to one aspect, this invention thus describes a process for underwater navigation control of a moving submarine vehicle, in which:

- at least one fin (in what follows, this can also be referred to as a "control surface") is mounted to rotate freely around an axis that is transverse to a roll axis of the vehicle, along which it is made to travel substantially in the said direction, where the vehicle has a reference angular position, in relation to its roll axis, corresponding to a substantially zero roll (meaning limited to a few degrees),
- this fin is ballasted in front of or behind its axis of rotation, and/or the torque of the buoyancy is used on this fin, by locating the majority of its volume respectively behind or in front of the axis of rotation in relation to the direction of travel, so that when the vehicle, and therefore this fin, tilts around the roll axis, the torque created by the ballast and/or the said buoyancy tends to pivot the fin around its axis of rotation, with the leading edge then naturally orienting itself downwards or upwards respectively, giving rise respectively to a diving or surfacing angle on the fin, which in turn generates a hydrodynamic force tending to return this fin to the said reference angular position of the vehicle corresponding to a reduced roll, while the vehicle is moving.

According to yet another aspect of this process, it is proposed to employ control means that functionally link the said free fin (and/or the said control surface therefore) to a ballast which itself is free to rotate around an axis parallel to the plane containing the roll axis and the yaw axis, so that when the vehicle tilts around the roll axis, the relative angular movement between the ballast and the body of the vehicle generates an action on the control means which then pivot the fin around its axis of rotation. The direction of the coupling between the movement of the ballast and that of the fin is then such that the angle that it adopts generates a torque that tends to return it to the said reference angular position of the vehicle, corresponding to a reduced roll, with the vehicle in motion naturally.

One can thus envisage fitting a ballast so that it pivots around the roll axis, with its movement acting upon the said fin, or modifying the force or even the orientation of the thrust of a propeller, so as to return the vehicle to near its zero roll.

This principle can be applied to the control of a fin (or several fins) mounted free to rotate on its axis, located below the vehicle, and ballasted in front of its axis so that, when the vehicle tilts around its roll axis (the bottom fin rises), the torque created by this ballast pivots the fin around its axis, with the leading edge then naturally orientating downwards, bringing about a dive attitude on the fin.

This effect can also be obtained by using the torque of the buoyancy on the fin, with the volume being placed mainly behind the axis of rotation.

The same result can also be obtained by placing the free fin in the vertical top position, and by placing the ballast and/or the volume to the reverse of what has been described above.

Although it would appear natural to design the vehicle so that, when stopped, the forces of gravity and buoyancy combine to hold it in the vertical position and stationary, the device does not exclude a vehicle which would find its vertical stationary position only in a dynamic manner, meaning when the vehicle is moving forward, its position when stopped then being uncertain.

The principle of the ballast-controlled fin can also be used to generate forces, with the free fin placed in the down position for example, and the vehicle can be fitted with one or more other, motor-driven fins (or other actuators) intended to control the vehicle and placed in the opposite half space. In this case, it is possible to deliberately attempt to destabilise the vehicle by creating a roll torque. Under the effect of this roll force, when the vehicle moves forward, the reaction of the bottom fin is to pivot until it creates a torque opposing the torque of the actuators, and therefore a force along the lateral axis of the vehicle. The vehicle then stabilises in a position close to the vertical, with a slight list, and the fin supplies lateral force that is capable of modifying the trajectory of the vehicle. Although not controlled, and free to rotate on its axis, the fin can therefore contribute to the control of the vehicle.

According to such an aspect of the invention, and to generalise, the invention therefore also concerns the creation of a submarine vehicle which, as known in its own right in US 2005-0268835-A1 for example (whose description is included by reference), includes a body in which the roll axis of the vehicle is located, and orientation means operated by actuators in order to control the vehicle, but with the particular feature here that the ballast will then be designed, mounted on the vehicle and located in relation to its fin and/or its associated control surface so that, with the vehicle moving forward along its axis of motion, controlled by the actuators, the ballast, under the effect of a roll force, pivots the fin (the control surface) until it creates a torque opposing the torque of the orientation means, and therefore a force along an axis that is transverse to axis of movement of the vehicle.

This is particularly useful for the control of moving vehicles whose fuel consumption needs to be reduced, and where stability is to be made robust.

As can be seen, a vehicle according to the invention, when submerged and in movement, can stabilise the position of one or more towed objects, to which it is connected for this purpose, in a specific application.

DESCRIPTION OF THE SEVERAL VIEWS OF THE DRAWINGS

Other characteristics and advantages of this present invention will emerge from the description that follows, relating to different methods of implementation, one of which is a preferred method. In the associated illustrations.

DETAILED DESCRIPTION OF THE INVENTION

Figure 1:
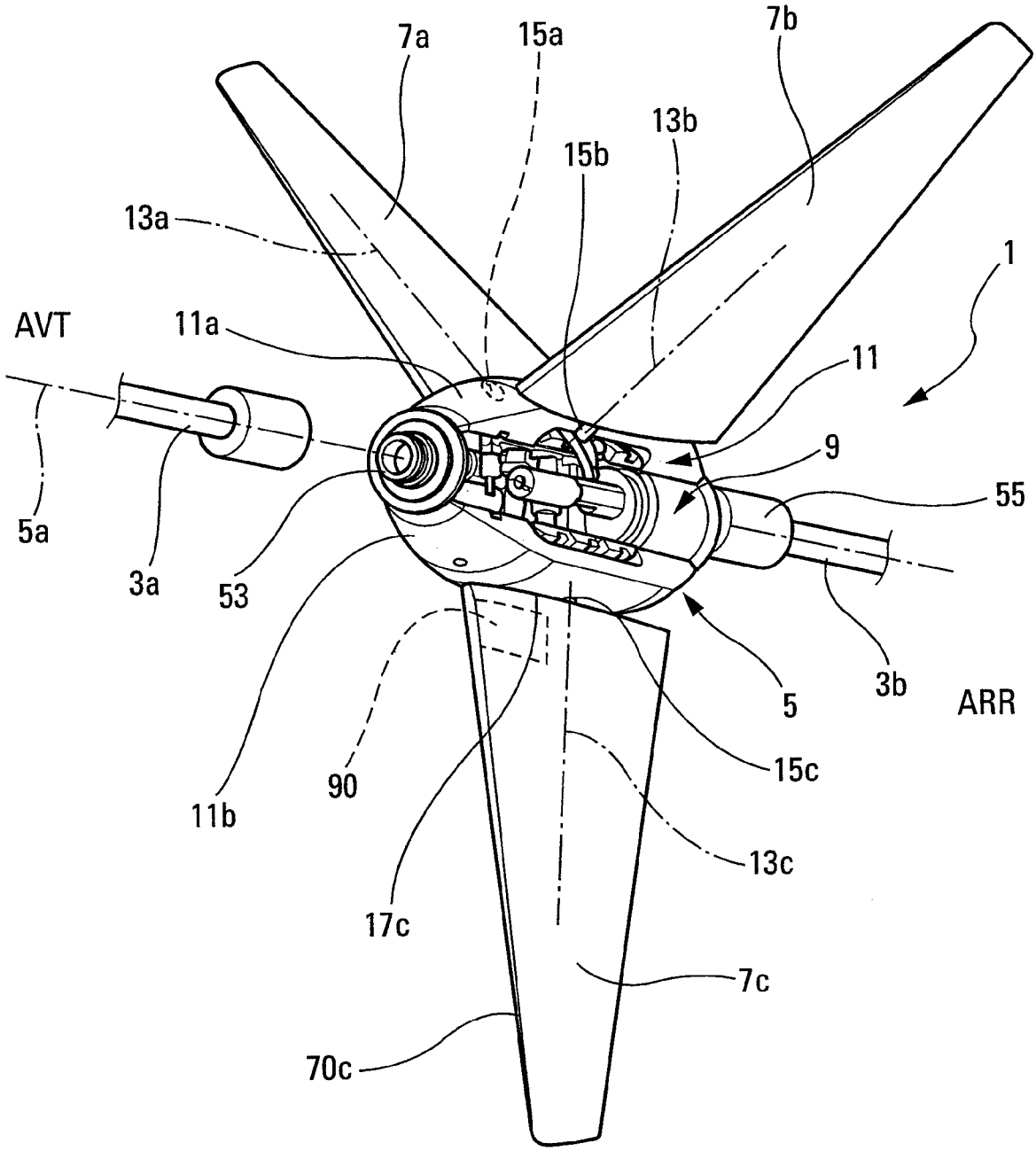
FIG. 1 is a view in perspective, with cut-away, of a control device according to the invention, when the vehicle lists to starboard.

In FIG. 1, a submersible submarine vehicle 1 according to the invention is used here to support and correctly position a towed submarine object, in particular a towed linear acoustic antenna 3.

The vehicle 1 had a hollow central body 5, and several fins arranged around it, here three in number 7*a*, 7*b*, 7*c*.

The body 5 has a longitudinal axis 5*a*, which is the roll axis of the vehicle.

This body includes a central fixed part 9 and a concentric outer shell 11, between which there exists a possible relative rotation around the axis 5*a*, so that the fins are thus able to rotate around this axis with the shell.

The fins, which lie along an axis (here radial) transverse to axis 5*a*, are mounted individually to rotate around a pivot lying along their respective transverse axes of rotation 13*a*, 13*b*, 13*c*.

To this end, each fin is fixed toward its root, at 17*c* for fin 7*c* here for instance, to a pivot shaft (here shaft 15*c* lying radially along axis 13*c*, for fin 7*c*).

Figure 2:
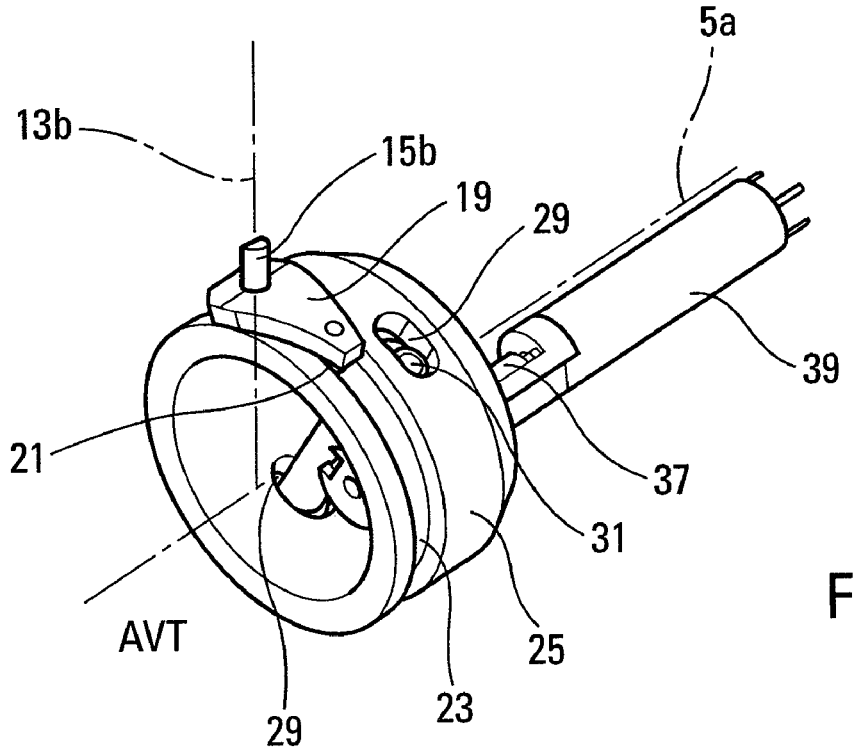
FIGS. 2 and 3 are two views in perspective of the fin control system driven by actuators.
Figure 3:
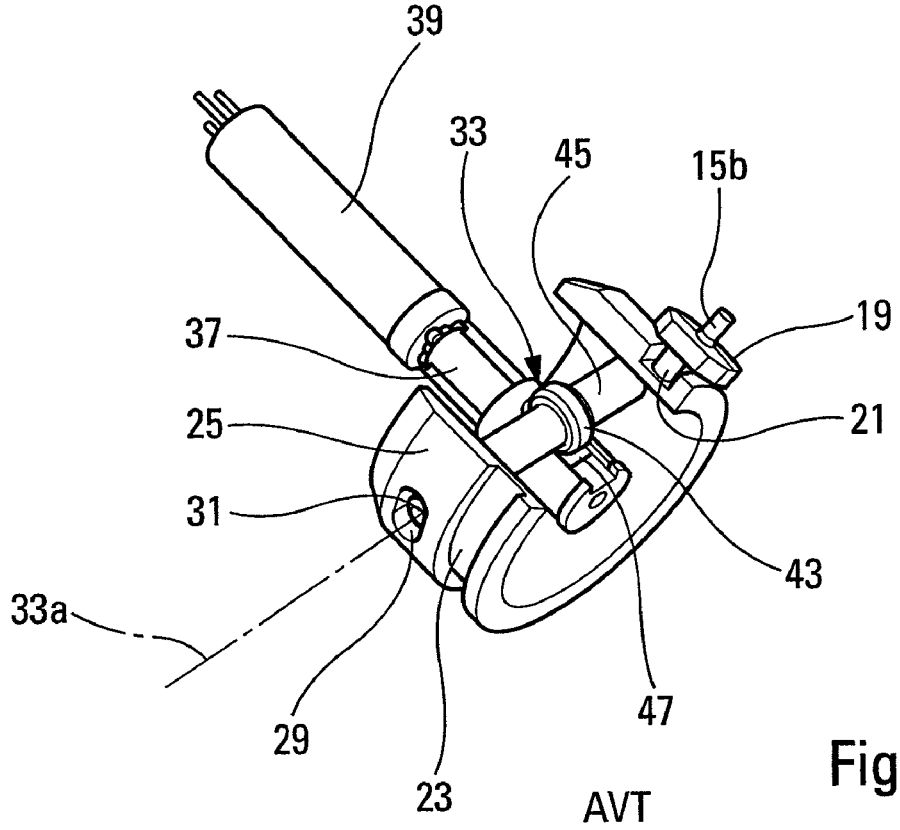

For the explanation concerning the fins, let us consider fin 7*b* (the mounting of the other fins being broadly similar), where radial shaft 15*b* traverses the outer shell 11, inside which it is connected to a transverse foot 19 that is fitted with a nipple or lug 21 which slides in the peripheral groove 23 of a ring 25 (FIGS. 1 to 3).

Offset along axis 5*a*, in relation to the groove, the ring 25 is traversed by two diametrically opposing holes 29 in each of which a finger 31 is moving (FIGS. 2 and 3).

Figure 4:
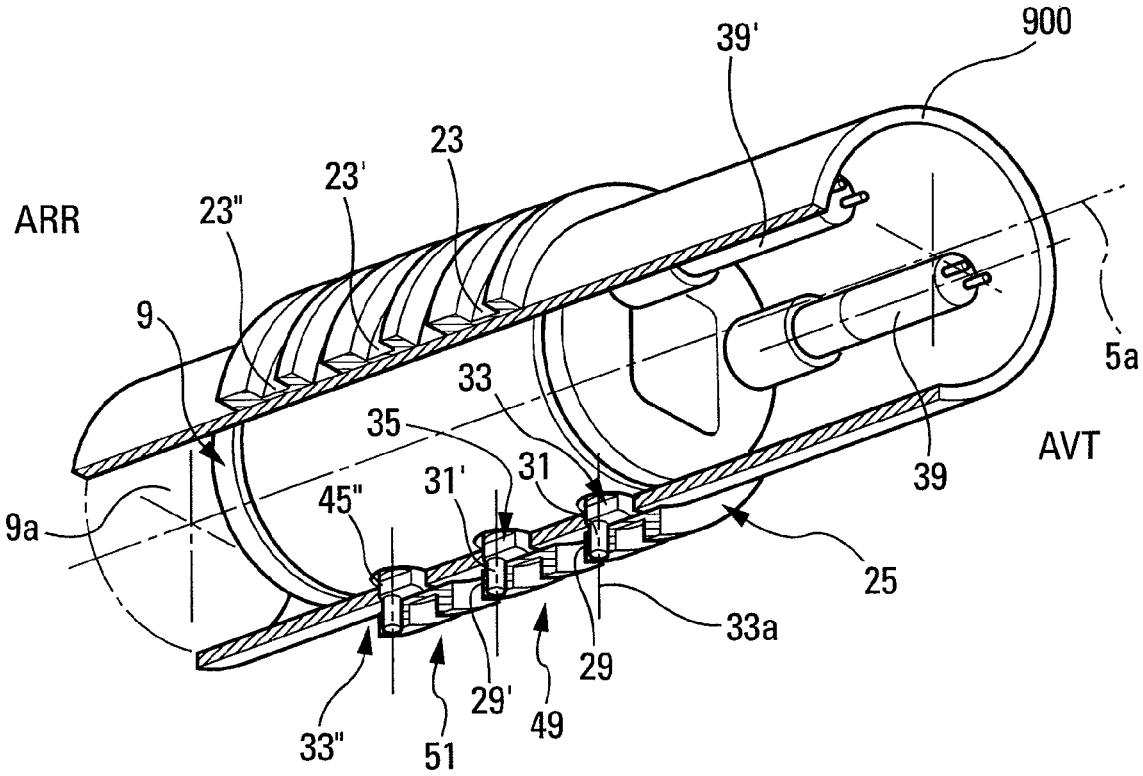
FIGS. 4 and 5 are two views in perspective, with cut-away, of the actuator system.
Figure 5:
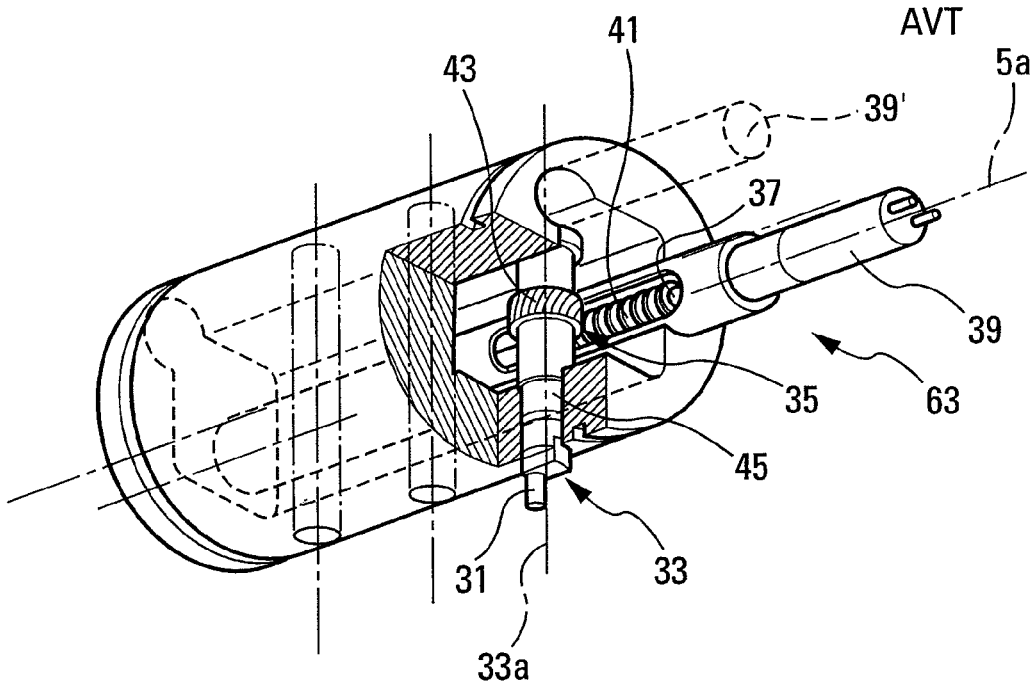

As also shown in FIG. 4 or 5, finger 31 is one element of a radial device with an eccentric offset 33, which is moved by a bellcrank 35 driven by the output shaft 37 of an electric motor 39.

For fin 7*c*, this control does not exist. It is therefore "free".

Shaft 37 is driven by a geared motor which drives, in rotation, an axial screw 41 on which the toothed wheel with radial axis 43 engages, thus forming the bellcrank 35 (FIG. 5).

The toothed wheel 43 is mounted on a radial shaft 45 which drives it in rotation.

The shaft 45 is equipped with an eccentric end offset, FIG. 3.

The mounting is identical for fin 7*a*, using ring 49 (FIG. 4).

Two motors (see FIGS. 4, 5: 39, 39') and two actuating devices 29, 29', 31, 31', 37, 43, 39, 39' . . . associated with the circular rings 25, 49, drive fins 7*a* and 7*b*.

The rotating rings 25, 49, and therefore the fins 7*a*, 7*b*, are offset coaxially along axis 5*a*.

Regarding the free fin 7*c*, its radial shaft 15*c* traverses the shell 11, being held axially in the latter so that it rotates in relation to it, and if necessary with it, around the roll axis 5*a*. In another solution, the axis is fixed to the shell, and the pivoting occurs within the fin.

The angular orientation of each fin in relation to this axis can thus be adapted, either freely under the action of the exterior and of the ballast (fin 7*c*), or controlled by the said motor-driven means (fins 7*a*, 7*b*) here thus known as "actuators". Other actuators (jacks) may also be provided.

The ballast 90 is mounted on the vehicle and located in relation to fin 7*c*, so that, with the vehicle moving forward along the roll axis 5*a*, a movement of the fin in the roll direction will generate a torque tending to pivot this fin around its axis 13*c*, with its leading edge 70*c* orienting itself naturally to bring about an attack angle on the fin which will return it to the said reference angular position of the vehicle, therefore corresponding to a reduced roll.

In the example of FIG. 1, and moving forward in the water, with no deflection imposed on the fins 7*a*, 7*b* and no significant imposed roll, fin 7*c* will be located in a substantially vertical down position, and the two fins, 7*a* and 7*b*, will position themselves naturally in the up position (above the body).

If it is then desired to exercise control over depth, control is applied to the actuators of the two upper fins 7*a*, 7*b* which are pivoted around their axis of rotation so that the vehicle 1 will apply a resulting vertical force on the upstream and downstream sections 3*a*, 3*b*, for example, of the towed object to which it can be connected (it is naturally assumed that the assembly will advance).

For lateral control (horizontal plane), the same two upper fins 7*a*, 7*b* will be controlled so that they pivot in the same direction.

Control of depth will preferably be a local control using a pressure signal, as described in US-2005-0268835-A1.

For a connection to the sections of towed objects (mechanical or electrical connection, signal stream, etc.), the central fixed part 9 of the body 5 is equipped with first and second connection ferrules 53, 55.

Figure 8:
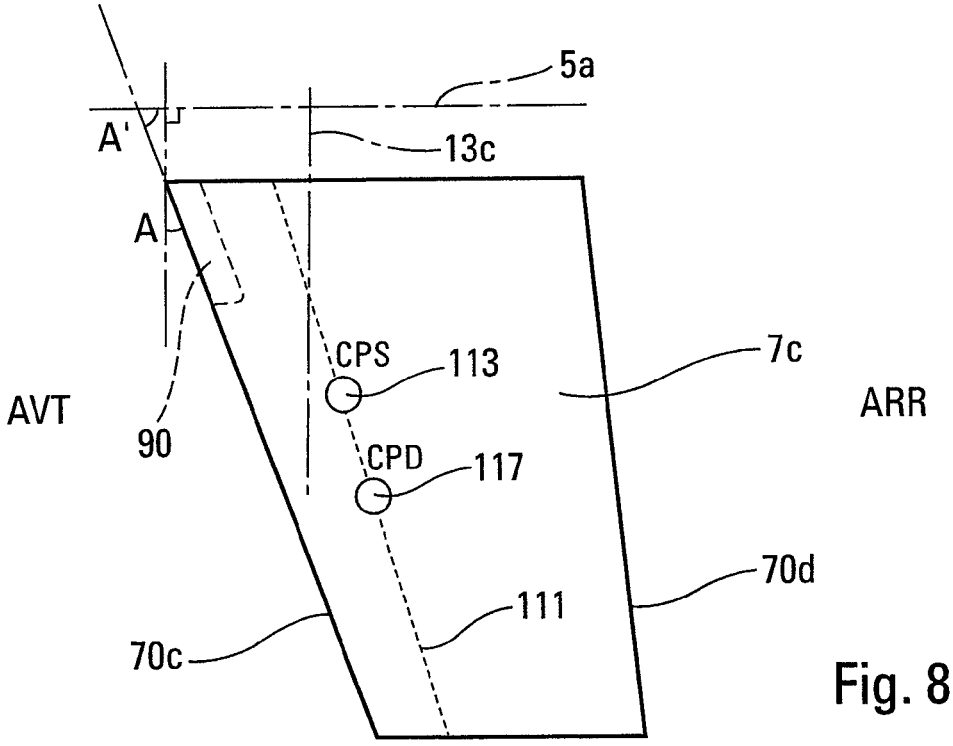
FIGS. 8 and 9 show the possible tilt of the axis of rotation and leading edge of the fin, and show, from the side, the line of application of the hydrodynamic forces, locating the hydrodynamic thrust centre.
Figure 10:
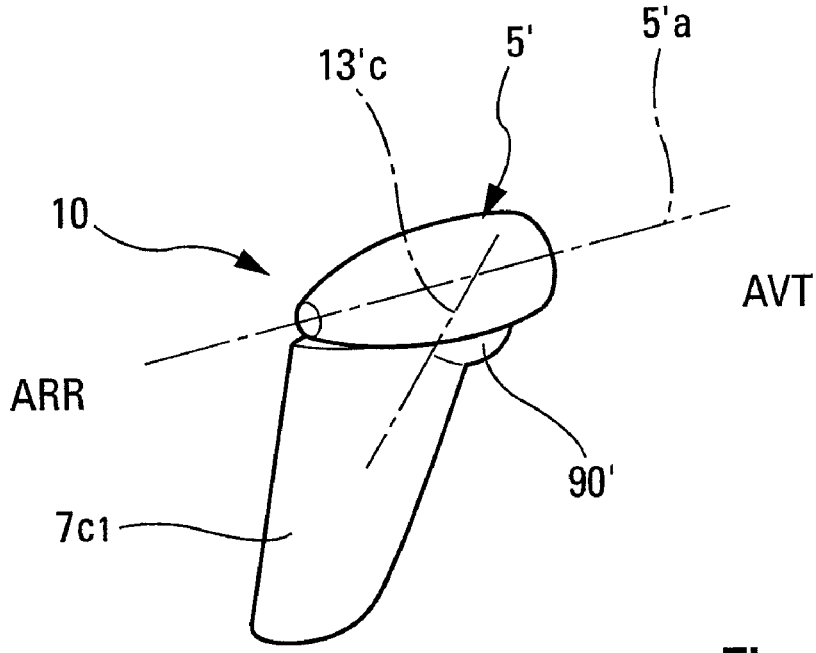
FIG. 10 shows a solution with a single (free) fin.

In FIGS. 1, 8 and 10, the free fin 7*c* is located below the body, and the ballast 90, 900, carried here by this fin, is located ahead of the pivot 13*c* (see front end denoted AVT).

Thus, when the vehicle is subjected to a roll movement, the bottom fin 7*c* tends to rise and the mass of its ballast tends to make it dive. The fin adopts a negative attack angle producing a force which drives it downwards, thus reducing the roll.

Figure 6:
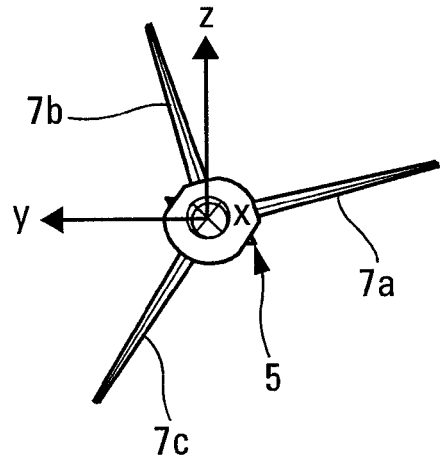
FIG. 6 shows the rear of the vehicle in lateral traction to starboard.

In FIG. 6, the ballasted free fin 7*c* is still shown at the bottom, and the roll force to starboard is due to the thrust of the upper fins 7*b*, 7*c*, which the bottom fin corrects only when the tilt is sufficient, as explained below.

Figure 7:
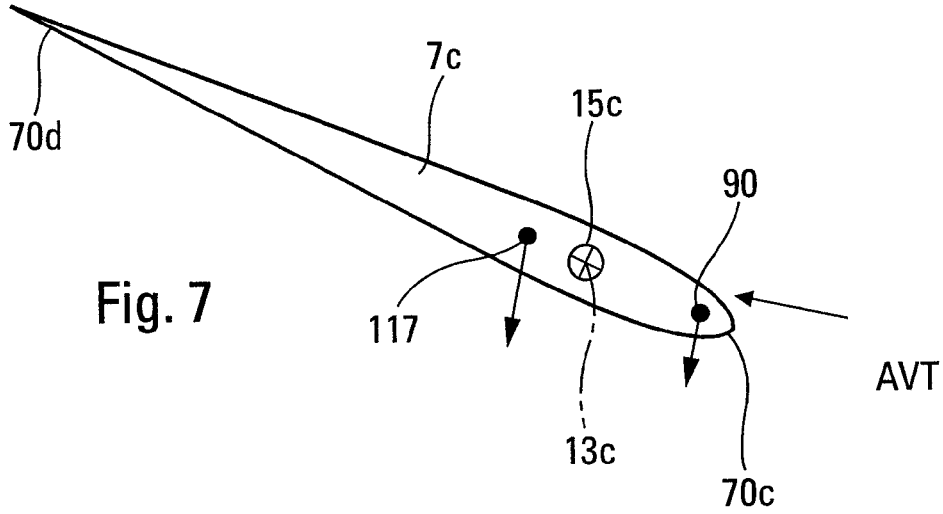
FIG. 7 shows the free fin of FIG. 6, along its axis, from the centre of the vehicle.

In FIG. 7, the ballast 90 causes the fin to dive when it is sufficiently offset from its reference angular position, corresponding to "zero roll.", thus straightening the vehicle.

Figure 9:
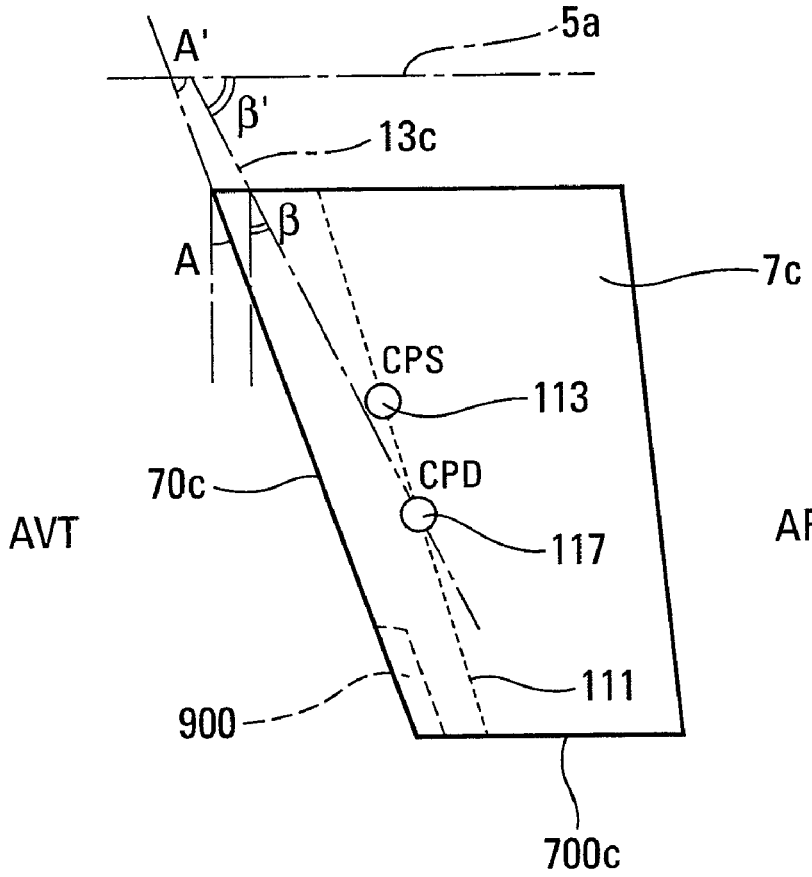

As illustrated in FIGS. 8 and 9, the hydrodynamic thrust centre (denoted CPD), indicated as 117, is preferably located behind the pivot axis 13*c* for this fin 7*c* (see front AVT and rear ARR indications). Thus the overall stability of the vehicle 1 is ensured in a natural manner.

At equilibrium, the hydrodynamic force is such that it produces a roll torque in opposition to the torque created by the other fins, here 7*a* and 7*b*. This force also creates a rotation torque on the fin. For its part, the weight is located in front of the axis 13*c* and creates a rotation torque on the fin about its axis, which, at equilibrium, opposes that of the hydrodynamic force.

FIG. 8 shows the line 111 of application of the hydrodynamic forces (thrust line) and also, located at 113, the static hydrodynamic thrust centre (denoted CPS). The thrust centre is located on this straight line, at a position such that the surfaces at the root end and at the free end of the fin are substantially equal. Equilibrium is attained when the torque of the weight about the axis of the fin substantially equals that of the hydrodynamic force. The vehicle therefore tilts until all of these forces are in balance.

The decision here to place the ballast at the base of the fin, close to the body 5 (especially in FIGS. 1, 8, and 10) was guided by two considerations in particular:

- the need for a maximum moment arm for the ballast,
- the need to favour a leading edge 70*c* inclined to the rear in relation to the vertical (see angle A in FIGS. 8 and 9), in order to limit the adherence of algae or the hooking of lines.

In FIG. 8, the axis of rotation 13*c* is assumed to be vertical or at least perpendicular to the roll axis 5*a*.

As shown in FIGS. 9 and 10, this axis 13*c* can preferably be inclined toward the rear so that, behind their point of intersection, the two axes 5*a*, 13*c* form an acute angle, β', between them, or β in relation to the perpendicular to axis 5*a* (see FIG. 9).

This tilt of the axis 13*c* by a angle of other than 90° can allow the equilibrium angle of the fin at rest to be proportional to the list of the vehicle and/or the damping by dynamic effect to be even more effective.

Tilting the axis 13*c* to the rear, and straightening the leading edge 70*c* of the fin, can favour damping of the oscillations when the vehicle generates lateral forces.

A leading edge 70*c* that is less inclined in relation to the vertical than is the axis of rotation of the fin (so that $A<\beta$, or $A'>\beta'$ if it is considered in relation to axis 5*a*), should be favourable in this situation.

Around 15 to 25 degrees of fin tilt, and fin axes inclined at between 15 and 35 degrees, can be envisaged.

This degree of tilt of the axis of rotation of the free fin can lead to placing the ballast at the end of the fin, closer to its free end 700*c*, as in FIG. 9, in which the ballast is shown as 900 and is located just behind its leading edge. Advantage is taken of the keel effect of the ballast which produces a natural stabilising torque, the latter ensuring vertical stability of the vehicle even when stopped.

The free fin can be created with advantage in a composite material incorporating a foam. Thus, in addition to the mass, which exerts a diving torque on the fin, the float effect of the foam produces the same effect through its buoyancy effect.

FIGS. 10 to 19 show other possible implementations, in particular in connection with the fact that the foregoing is applicable to a solution with a control surface alone and/or to a fin fitted with a control surface.

Thus, in FIG. 10, the vehicle has only one fin 7*c*1 ballasted at the front, at 90' for example, and mounted free to rotate about its pivot axis 13'*c* in relation to the central body 5' of the vehicle roll axis 5'*a*. It can include some or all of the foregoing considerations. The body 5'of the vehicle 10 can be of the single block type.

Figure 11:
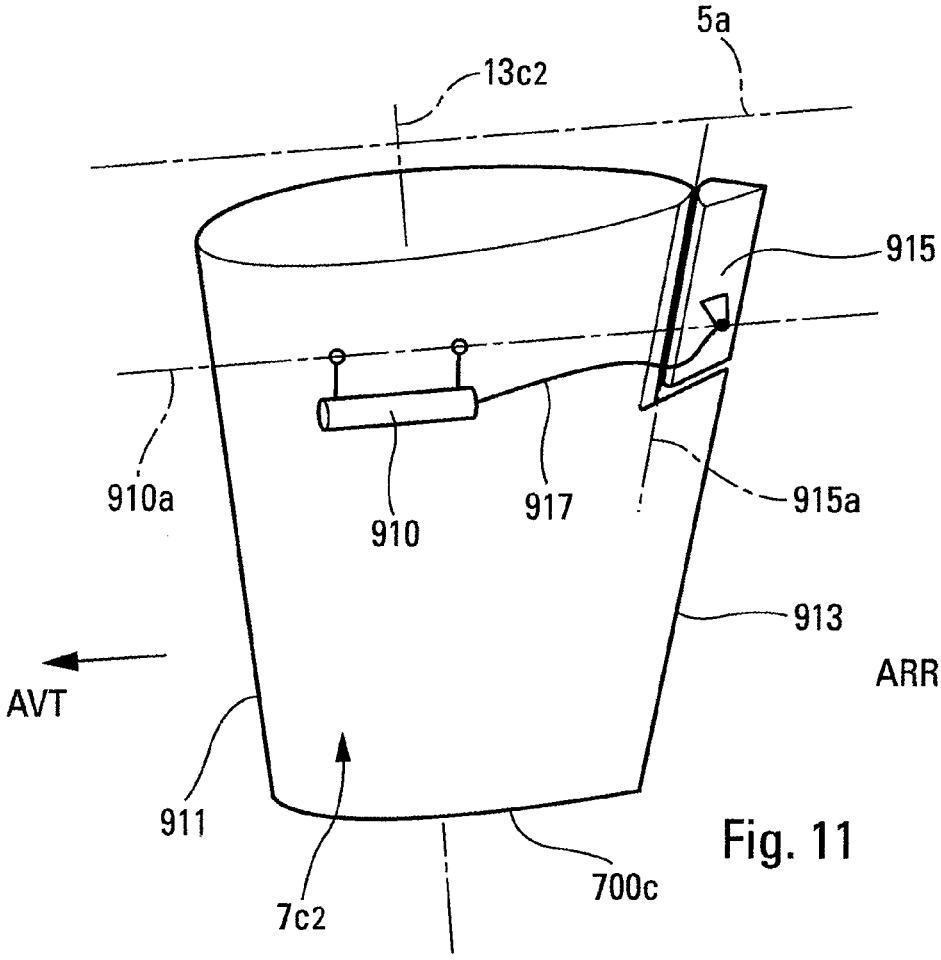
FIG. 11 shows a solution with a hollow pivoting fin and with rear control surface subject to the direct effect of a ballast, FIG. 12, a fin solution with a rear control surface subject to the direct effect of a ballast.

In FIG. 11, the ballast 910 is mounted on fin 7*c*2, which pivots freely around its axis of rotation 13*c*2, intersecting the roll axis 5*a*, which can be that of the body of the vehicle concerned, not shown here.

On the fin, which can be hollow, the ballast 910 is mounted free to rotate around an axis 910*a* passing through the leading edge 911 and trailing edge 913 of the fin.

Here, the ballast 910 is placed at the root of the fin, which has a pivot shaft on axis 13*c*2. The ballast could be closer to the free end of the fin, or placed on the outside, beyond the end of the fin for example.

At the rear ARR, the fin has control surface 915 which here is mounted to pivot around an axis 915*a* parallel to axis 13*c*2, along the trailing edge 913.

If fin 7*c*2 were fixed, mounted in a rigid manner on the body of the vehicle, the pivoting control surface 915 would advantageously be placed closer to the free end 700*c*.

The ballast 920 and the control surface 915 are functionally connected together by a control element 917, such as a flexible cable or rod, so that pivoting of the ballast around its axis 910*a*, as a result of a roll force, acts on the control surface 915, or even on the fin if it is itself mounted to pivot, to return the vehicle to its reference angular roll position and/or to contribute to its orientation, when it is moving ahead AVT substantially parallel to axis 5*a,* to within an angle possible of side-slip pres.

Figure 12:
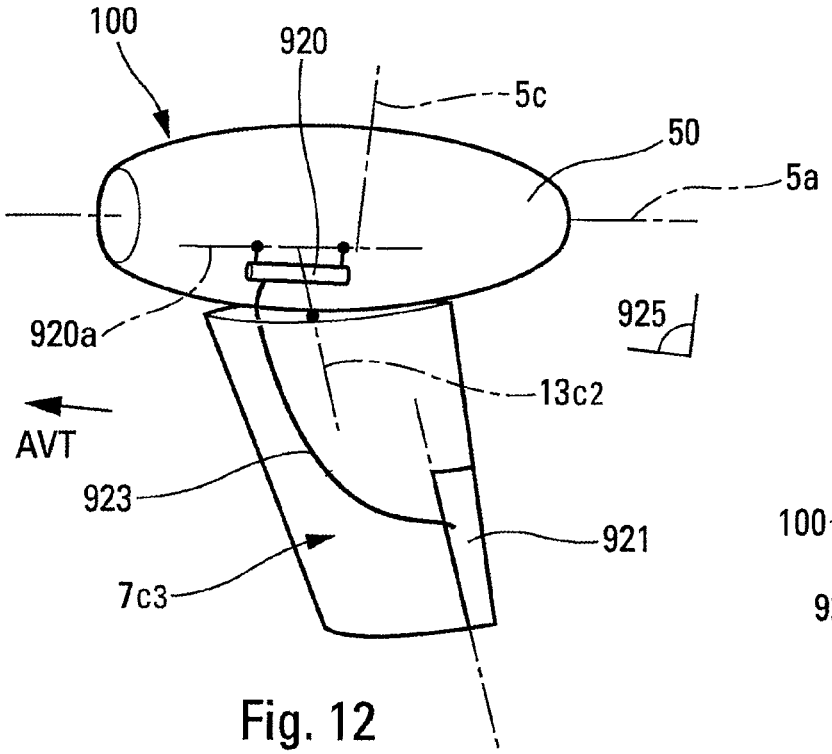

In FIG. 12, the ballast 920 has a direct effect on a control surface 921 mounted to pivot on and in relation to a fin 7*c*3 mounted on a vehicle body 50 with a roll axis 5*a*.

Fin 7*c*3 can be mounted so that it is fixed onto the body 50.

It can also be mounted along axis 13*c*2, under the control of actuating means, like the aforementioned fin actuators 7*a* or 7*b*. This will result in a fin 7*c*3 that is motor-driven with a control surface or aileron 921 that in turn is controlled in the roll direction by the ballast 920, which is functionally linked to this control surface by control 923.

Control 923 can be any of the foregoing.

The ballast 920 is inside the body 50, and pivots freely through an angular sector, around axis 920*a*, parallel to plane 925 containing axis 5*a* and yaw axis 5*c*. This characteristic can be applied to the case in FIG. 11 or 14.

Figure 13:
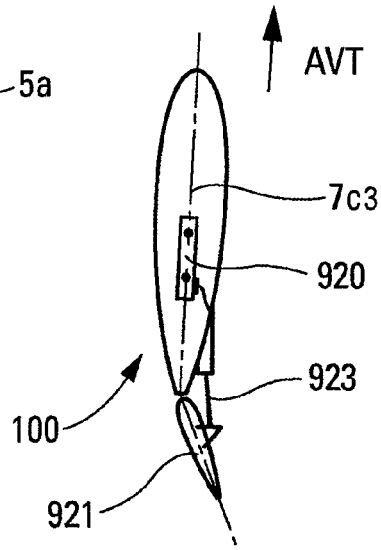
FIG. 13 is a plan view of the fin with the control surface of FIG. 12.

In FIG. 13, in which it is assumed that fin 7*c*3 is immobile, if a list to port occurs while the vehicle 100 is moving forward, a rotation of the aileron 921 occurs, under the effect of the ballast 920, creating lift and resulting in limitation of the roll.

Figure 14:
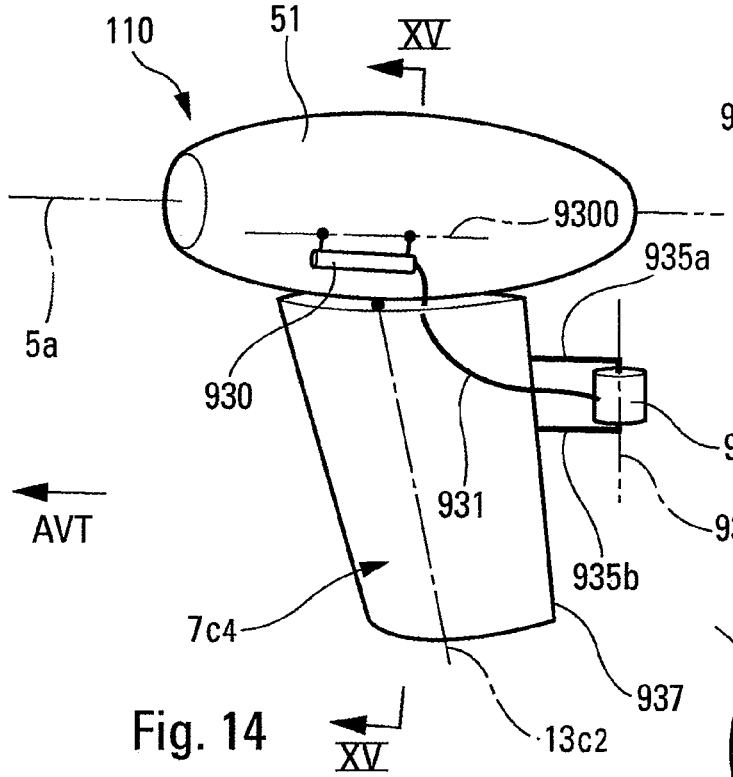
FIG. 14 shows a solution with a freely pivoting fin and rear aileron, and that is subject to the indirect effect of a ballast.

FIG. 14 and those that follow, show an indirect-effect solution in which a list around the roll axis generates a rotation of the control surface leading to rotation, by variation of the attack angle, of the fin bearing this control surface, and so to a reduction of the list.

In FIG. 14, the ballast 930 is placed in the body 51 of the vehicle 110.

The ballast 930, which could be outside the body 30 (as in the solution of FIG. 12), pivots around an axis 930*a* parallel to 5*a*.

In the event of a roll, a control of the aforementioned type 931 transmits the effect of the ballast to the rear control surface 933. This control surface pivots in relation to and behind fin 7*c*4, which is free to rotate on and in relation to the body 51, around axis 13*c*2, which intersects roll axis 5*a* and passes through its root and free-end edges.

The axis 933*a* of the control surface 933 also intersects axis 5*a*, but is not necessarily parallel to axis 13*c*2.

The pivoting shaft of the control surface along axis 933*a* is carried by rods 935*a* and 935*b*, fixed to the fin and extending behind its trailing edge 937.

Here, fin 7*c*4 is assumed to be free to rotate around its axis 13*c*2, and is not even subject to the direct effect of any ballast.

Figure 15:
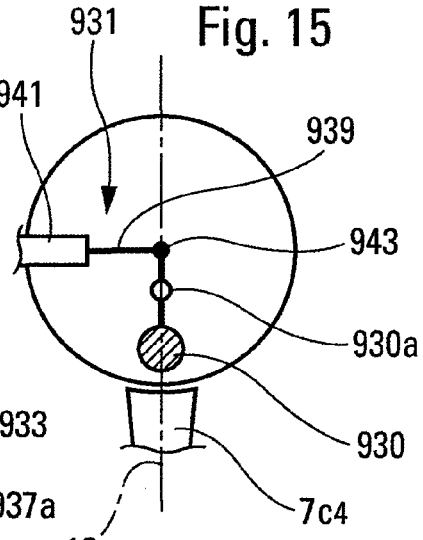
FIGS. 15 and 16 show a schematic view in section along plane XV-XV (from the rear), at zero list (FIG. 15) and with the vehicle tilted (FIG. 16)
Figure 16:
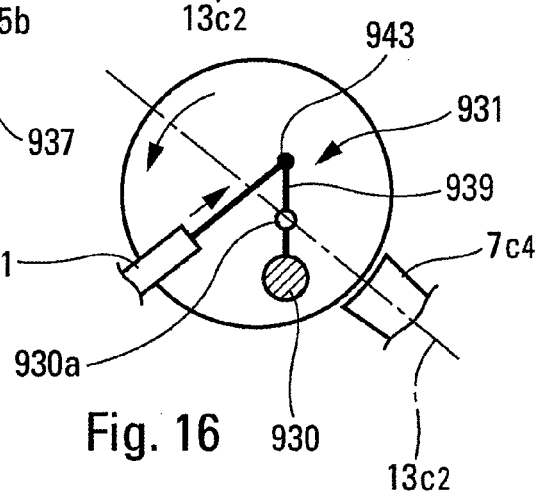

In FIGS. 15 and 16, control 931 can include a cable or a flexible rod 939 for example, sliding in a sheath 941 and connecting the control surface 933 in FIG. 14 on one side and the ballast 930 on the other, by means of a pivot or a swivel 943 which is therefore mounted to pivot around its axis.

Let us assume, as illustrated in FIG. 15, that general equilibrium of the vehicle 110 is such that if it advances substantially along the roll axis 5*a* of FIG. 14, it will position itself naturally with the free fin 7*c*4 vertical and pointing downwards, unaffected by any directional force exerted.

FIG. 16 shows what happens if the vehicle lists and if, as a consequence, the axis 13*c*2 of fin 7*c*4 tilts in relation to the vertical. When the vehicle lists to port, the cable 939 is pulled. However it is pushed if the vehicle lists to starboard, with the aforementioned induced effects.

Figure 17:
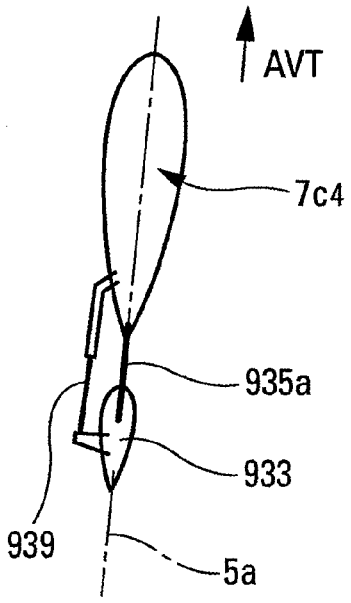
FIGS. 17, 18 and 19 are three plan views of the fin with the control surface of FIG. 14, at zero list (FIG. 17) and with a list (FIG. 18 and then 19).
Figure 18:
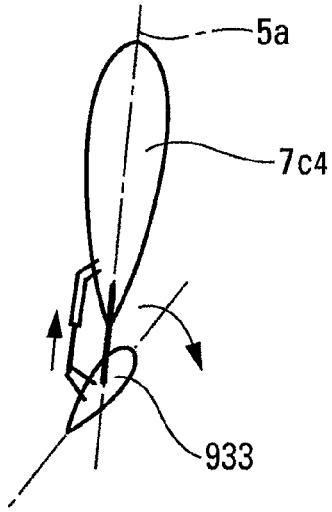

In FIG. 17, the vehicle advances to its position of FIG. 15. The cable 939 and fin 7*c*4 are in a neutral position. In the absence of side-slip, the fin and the rear control surface 933 can be oriented along roll axis 5*a*.

Figure 19:
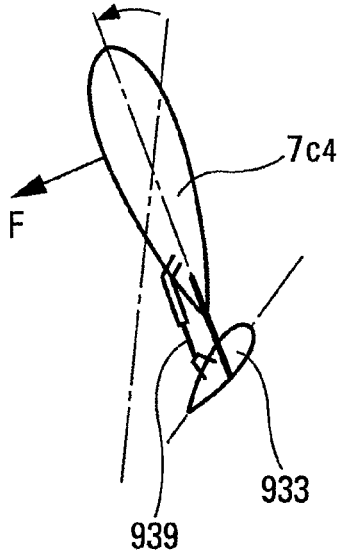

In FIG. 19, in the event of a list to port, the ballast drives the control surface 933 in rotation, due to the force generated by the roll. This provokes a rotation of fin 7*c*4. The main generated force F then straightens the vehicle.

Finally, it is recalled that the orientation of the fins, whether fixed or pivoting 7*c*, 7*c*1 . . . 7*c*4 will not necessarily be downwards when the vehicle concerned is moving forward, and their angular position at rest can theoretically be anything, as can the number of fins and/or control surfaces on the vehicle.

The invention claimed is:

1. A process to control the underwater navigation of a submarine object having a roll axis along which the object is substantially travelling in a determined direction, the object occupying a reference angular position in relation to said roll axis, corresponding to a substantially zero roll, the process comprising:

providing the object with at least one of a fin and a control surface adapted to rotate around a transversal axis which is transverse to said roll axis, said at least one of the fin and the control surface having a determined buoyancy and first and second volumes respectively located, in relation to the direction of travel, behind and in front of said transversal axis of rotation, and, using a torque of said buoyancy, by having one of said first and second volumes more voluminous than the other, so that when the object tilts around the roll axis, the torque created by said buoyancy tends to pivot said at least one of the fin and the control surface around said transversal axis of rotation, bringing about one of a diving and a surfacing attitude, which tends to return the object toward its reference angular position.

2. A submarine object comprising:

a body having a roll axis, and a reference angular position corresponding, in relation to said roll axis, to a substantially zero roll, at least one fin mounted to pivot on the body, around a transversal axis that is transverse to the roll axis, said fin having a front leading edge, and, a fin driving ballast arranged on the object for creating a torque induced by a rolling tilt of the body, while the object is travelling forwardly in water along a travelling direction that coincides substantially with the roll axis, thereby causing a change of the attack angle on the fin tending to return the body toward said reference angular position, wherein, the ballast is disposed on the fin and offset in one of a frontward direction and a rearward direction in relation to the transversal pivot axis of said fin, and, the leading edge of the fin is more inclined in relation to the roll axis than is said transversal pivot axis of the fin.

3. The object according to claim 2, further comprising:

additional fins, each mounted on said body to pivot thereon around an axis of rotation transverse to said roll axis, and, actuator means connected to the additional fins, for actuating said additional fins.

4. The object according to claim 3, wherein actuated by said actuator means the additional fins can create said rolling tilt of the body.

5. The object according to claim 2, wherein said fin incorporates a foam having floating qualities which, via a buoyancy effect, amplify the action exerted upon it by the ballast.

6. The object according to claim 2, wherein said at least one fin is mounted on the body so that said at least one fin is adapted to rotate around said transversal axis under the solicitation of forces external to the object, via the ballast.

7. A submarine object comprising:

a body having a roll axis, and a reference angular position corresponding, in relation to said roll axis, to a substantially zero roll, a fin mounted to pivot on the body, around a transversal axis that is transverse to the roll axis, said fin having a front leading edge, a control surface rotatably mounted on said fin around a transversal axis that is transverse to the roll axis, said control surface having a front leading edge, and a ballast arranged on the object to drive at least one of the fin and the control surface by creating a torque, induced by a rolling tilt of the body, while the object is travelling forwardly in water along a travelling direction that coincides substantially with the roll axis, said torque created by the ballast driving at least one of the fin and the control surface to pivot around the corresponding transversal axis, with the leading edge then naturally orienting itself to bring about an attack angle on said at least one of the fin and the control surface tending to return the body toward said reference angular position, wherein, the ballast is disposed on the fin and offset in one of a frontward direction and a rearward direction in relation to the transversal pivot axis of said fin, and, the leading edge of the fin is more inclined in relation to the roll axis than is said transversal pivot axis of the fin.

8. The object according to claim 7, further comprising:

additional fins, each mounted on said body to pivot thereon around an axis of rotation transverse to said roll axis, and, actuator means connected to the additional fins, for actuating said additional fins.

9. The object according to claim 8, wherein actuated by said actuator means the additional fins can create said rolling tilt of the body.

10. The object according to claim 7, wherein said fin incorporates a foam having floating qualities which, via a buoyancy effect, amplify the action exerted upon it by the ballast.

11. The object according to claim 7, wherein at least one of said fin and said control surface is mounted around the respective transversal axes so that said at least one of the fin and the control surface is adapted to rotate therearound under the solicitation of forces external to the object, via the ballast.

* * * * *